US005186949A

United States Patent [19]

Lai

[11] Patent Number: 5,186,949

[45] Date of Patent: Feb. 16, 1993

[54] FILLER INJECTOR FOR FILLING CRACKS IN CONCRETE

[76] Inventor: Mei H. Lai, 5F. No. 3-1, Yung Yeh Road, Hsin Tien City, Taipei County, Taiwan

[21] Appl. No.: 670,782

[22] Filed: Mar. 19, 1991

[51] Int. Cl.[5] ..... B29C 45/17

[52] U.S. Cl. ..... 425/11; 52/514; 156/94; 264/36; 425/13; 425/555; 425/563

[58] Field of Search ..... 425/11-13, 425/555, 563, 564, 568, 557; 52/514, 743, 744; 264/36; 156/94

[56] References Cited

U.S. PATENT DOCUMENTS

| | | | |
|---|---|---|---|
| 4,430,841 | 2/1984 | Yamaguchi et al. | 52/514 |
| 4,555,286 | 11/1985 | Orikasa et al. | 425/13 |
| 4,622,085 | 11/1986 | Yamada et al. | 425/13 |
| 4,861,401 | 8/1989 | Miura et al. | 425/13 |
| 4,986,862 | 1/1991 | Matsufuru | 425/13 |

FOREIGN PATENT DOCUMENTS

| | | | |
|---|---|---|---|
| 2-225771 | 9/1990 | Japan | 52/514 |
| 2-240379 | 9/1990 | Japan | 52/514 |
| 8702404 | 4/1987 | PCT Int'l Appl. | 52/514 |

*Primary Examiner*—Tim Heitbrink
*Attorney, Agent, or Firm*—Larson and Taylor

[57] ABSTRACT

The present invention relates to a filler injector for applying a filler to crevices in concrete surfaces. The injector has a transparent outer tube having scale markings thereon to indicate the pressure of any filler backing up from the surface and an adaptor connectable to a pressurized source of filler and screwed onto the outer tube. The injector also includes a check valve mounted in the adapter, an inner tube mounted inside a closed top of the outer tube and having a bore therein which can convey the filler from the adaptor to the surface, and a piston slidably mounted inside the outer tube and on the inner tube. The filler injector thus will not result in unwanted explosion, implosion, or skipping of a seam joint because of the pressure of the filler, and will provide a reading of the filling pressure on the concrete surface as the filler is being applied.

11 Claims, 3 Drawing Sheets

PRIOR ART

FILLER INJECTOR FOR FILLING CRACKS IN CONCRETE

SUMMARY OF THE INVENTION

The present invention relates to a kind of injector intended to fill, that is, to inject filler into the crevices and fissures present and in need of being patched up in a pillar, post, or similar structures of a building. The invention device is essentially composed of interacting screwup components complementing each other, such that it is safe enough to rule out the possibility of structural breakdown, implosion or explosion when the filling is in progress. The device has the added advantage that a correct reading indicative of the pressure which accompanies the filler being injected into the crevices can be obtained by casting a glance at the scale as a function of the relative displacement of the piston defined in-between the inner tubing and outer tubing of the device.

BACKGROUND OF THE INVENTION

A well known fact is that the reason that an RC (or reinforced concrete) structure can withstand considerable loading is the interactive traction between adjoining bodies of RC, and between an RC structure and the skeleton ribs therein. It is to be noted, however, that in respect of such an RC structure, if it should yield to give occasion to the creation of crevices of fissures owing to an earthquake or a catastrophic event of comparable effects, the overall structural load will then converge and build up pressure onto these crevices. Also, overtime, exposure of the skeleton ribs contained in the RC structure will eventually be subjected to rust-bound corrosion of the ribs due to contact with weathering elements, such as air and precipitation, rainfall in particular, as a result of these crevices. The stress concentration owing to the afore-mentioned crevices and rib corrosion constitute a formidable threat to the structural safety features of the building in question.

Up to the present day, a general practice to take care of the structural crevices in a building is to inject a type of filler into the crevices with a view to reinforce the traction force of the crevice. The RC crevice is also filled to block the skeleton rib from exposure to the atmospheric air and rain precipitations so as to prevent the rib from corrosion. The filler is filled into said crevices by an injector with the injection pressure being maintained at 5 Kg/cm, and the injection pressure will reverse and feed back to the same injector whenever the crevice recess is filled up with the incoming filler. Such a backfeeding pressure can very often cause skip-explosion of the rubber bond that is used in a conventional injector for the purpose as disclosed. Another shortcoming with such a conventional execution is the lack of a expedient form of pressure scale which could help to confirm whether said crevice in its entirety is completely filled with the filler.

In view of the foregoing, therefore, the present invention is proposed by the inventor by taking into accounts years of expertise and engineering experience, for presentation in the form of an improved Filler Injector aimed primarily at the prevention of any skip-explosion owing to the backfeed of injection pressure occurring at the joint which would undermine the entire filler patchup process.

Also, by providing a positioning scale indicative of the instantaneous position of the piston that is travelling between the inner tubing and the outer tubing as a function of the respondent pressure in the injector as the filling is in progress, it is possible to decide whether the filler injected into the crevice has reached a prescribed saturation pressure, and that is another objective of the invention.

BRIEF DESCRIPTION OF THE DRAWINGS

Other features and advantages of the invention will emerge as the description proceeds herein by reference to the accompanying drawings, in which.

DETAILED DESCRIPTION OF THE PREFERRED EMBODIMENT

Figure 3:
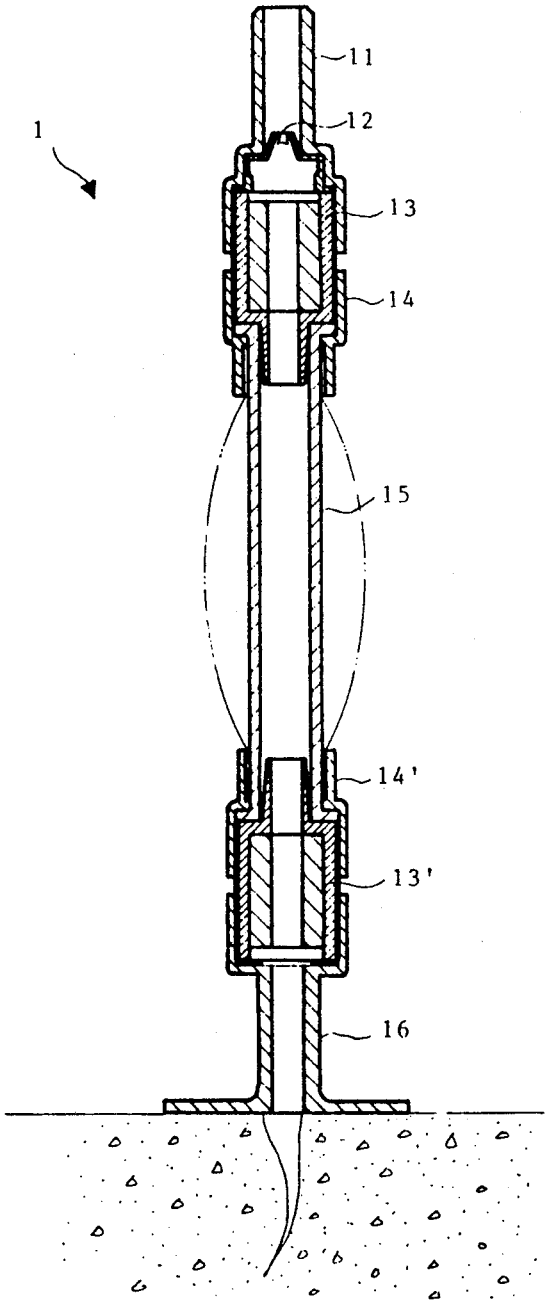
FIG. 3 is a diagrammatic cross-sectional view of a conventional injector indicated for the same purpose as in the case of the present invention.

Referring to FIG. 3, a diagrammatic cross-sectional view of a conventional injector (1) serving the same purpose as does the present invention is depicted and comprises a jacket (13) whose upper side is screwed to an injection nozzle (11), and whose lower side is screwed to a fastening cap (14). Cap (14) further has sleeves comprised of a rubber tube (15), longitudinally extensible and meant for extension outboard the cap (14), such that the rubber tube (15) is subjected to tighten up in-between as the jacket (13) is screwed up for engagement with the cap (14). Also, the same procedure shall apply with respect to the other side of the same rubber tube (15) by compressing the fastening cap (14') and the jacket (13') altogether directed thereto, while the underside of the jacket (13') is screwed to a chassis (16).

To apply the afore-mentioned conventional device for operation, high-pressure filler is pumped into injector (1) via injection nozzle (11) and forced into the crevices of an ailing building by way of the jacket (13), rubber tube (15), jacket (13') and chassis (16). Since in the course of the injection filling the crevice voids, once filled full with the filler, will react upon the filler being released and that results in pressure fed back to the injector. A check valve (12) is provided in the said injection nozzle (11) such that the backfeed pressure may be absorbed by the extensible rubber tube (15). This forces the rubber tube to expand, so that, by observing the extent of expansion of the rubber tube (15), the operator may decide whether the crevice has been filled up in full, or still, whether the closing pressure applied on the filler being released has reached the prescribed level.

Execution of the filling procedure as disclosed in the foregoing paragraph will doubtless see the eventual expansion of the rubber tube (15). However, as a result of the expansion, very significant tearing effects are rendered on portions tightened up by the jacket (13) (13') and fastening cap (14) (14'). In addition the very fact that rubber is an elastic substance can result in the rubber tube (15) failing as a consequence of the skip-explosion of the compressed portion on both ends.

Another point deserving attention is that visual decisions of the operator based on the extent of expansion of the rubber tube (15), as to whether the filler has been filled in full over the crevice or that the ultimate filling pressure has reached, is largely far from being accurate and to the point, visual inspection as such would thus foreseeably undermine the engineering quality of a crevice filling patchwork.

Figure 1:
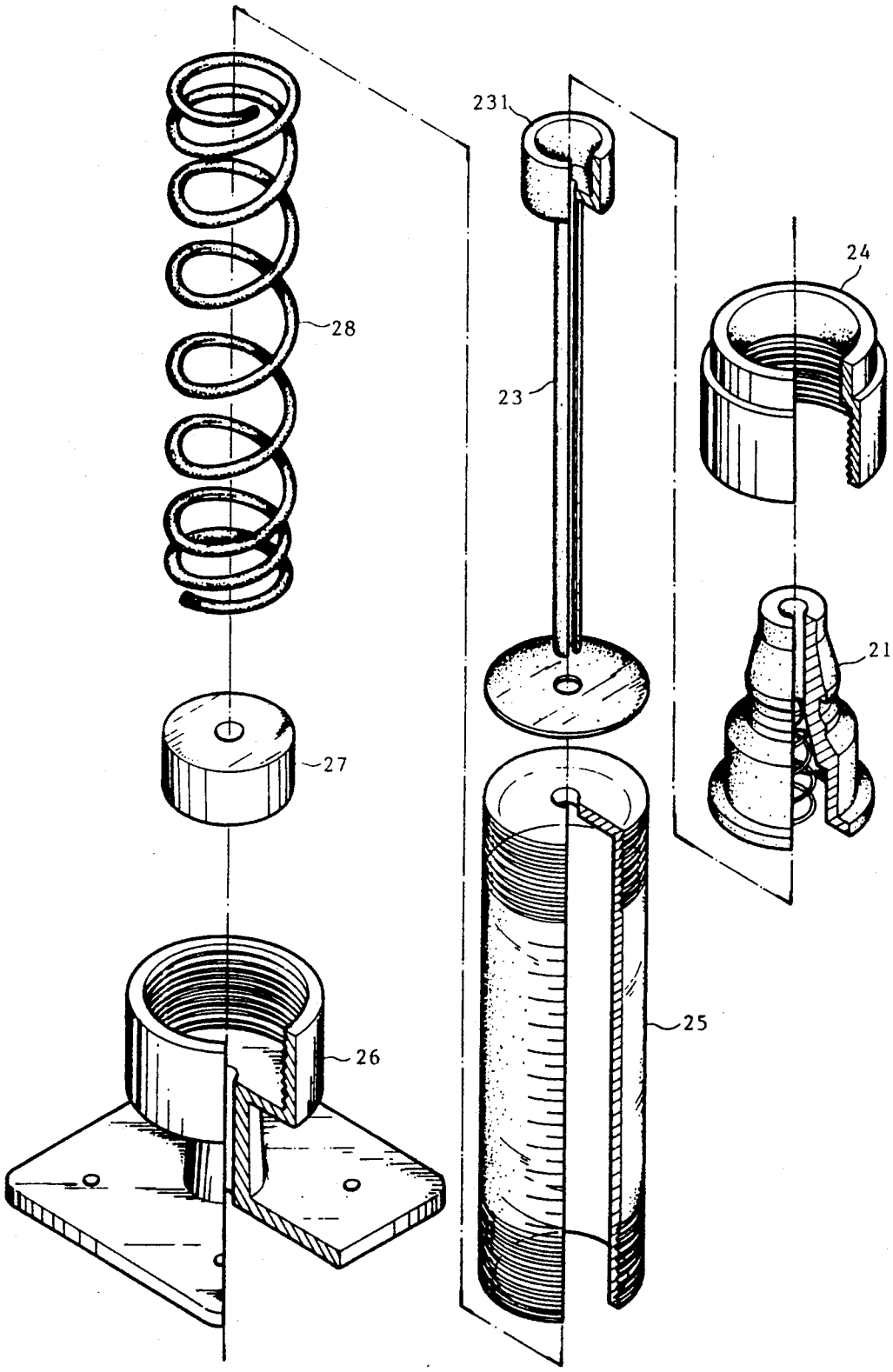
FIG. 1 is a three-dimensional exploded perspective view of the invention.
Figure 2B:
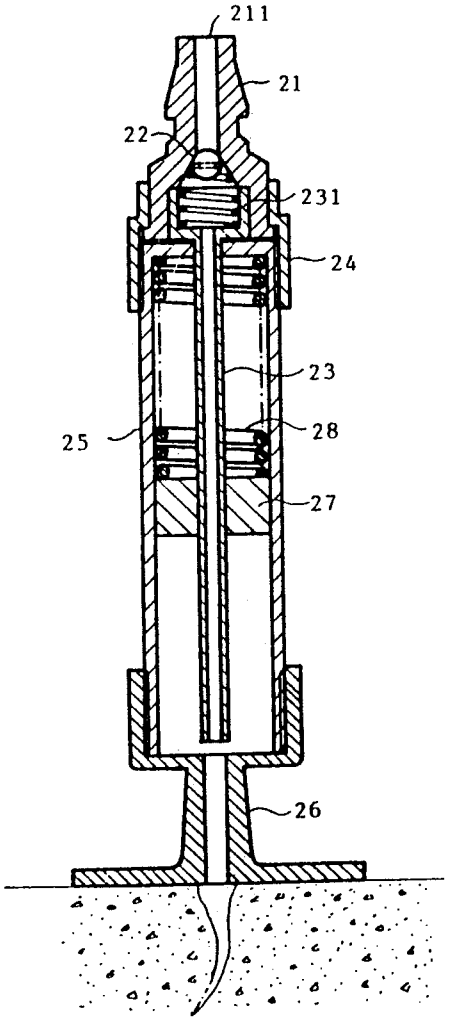
FIGS. 2*a* and 2*b* are two cross-sectional schematic views of the filler injection assembly at different stages in the filling process according to the invention.
Figure 2A:
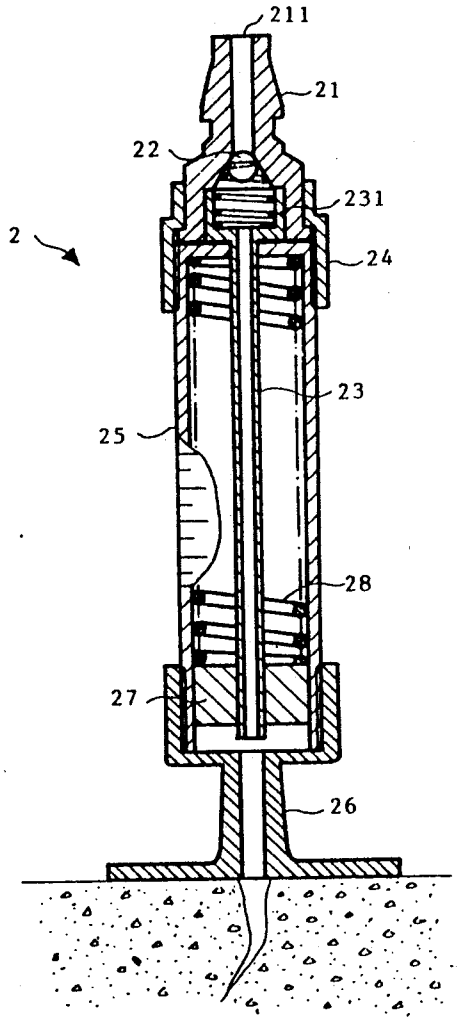

With such shortcomings inevitable with the execution of a conventional filler injection device in mind, a further description in detail of the invention improved device is given specifically with reference to FIG. 1 and FIGS. 2*a* and 2*b*.

Structurally the invention injector (2) comprises a cylindrical outer tubing (25), externally threaded at each end and made of translucent steel of a given length having scale markings thereon, and of which the upper end is closed. Injector (2) is also provided with an inner tubing (23) of a smaller diameter but of a length slightly shorter than that of the outer tubing (25) inserted into the closed centre of the upper part of the outer tubing (25), the inner tubing (23) being positioned by insertion into the mounting (231) on top. Above both said inner tubing (23) and outer tubing (25) is a high speed adaptor (21) mountable on the closed end of outer tubing (25) by means of an internally threaded fastening cap (24) screwed onto outer tubing 25, and in doing so compressing the mounting (231) for the inner tubing (23) therein. The underside of said outer tubing (25) is screwed to a chassis (26). A piston (27) and spring (28) are incorporated in the outer tubing (25) such that the diameter of the piston (27) is mathematically equal to the inner diameter of the outer tubing (25), with the inner tubing (23) functioning in the capacity of a guide rail to facilitate up-and-down movement of the piston (27) while in engagement with the inner tubing (23). A spring (28) is provided in the enclosure defined by the upper side of said piston (27) in relation to the outer tubing (25). Spring (28) serves to maintain piston (27) in its startup or beginning position; that is, the passive position in the absence of any force acting thereupon. A check valve (22) is provided on fast speed adaptor (21).

For appreciation of the injection procedure according to the invention reference is made to FIG. 2, whereby it is seen that high-pressure filler incoming by way of high-speed adaptor (21) is fed to nozzle (211) and injected into the crevice of an object building via inner tubing (23) and chassis (26). The moment the crevice is filled in full with the incoming filler, the filler in turn will produce a back pressure upon the injector (2). Because of check valve (22) the back pressure will react to exert an upward push against said piston (27); the piston in turn moves alongside the inner tubing (23) to a point of eventual equilibrium between the injection pressure and the pressure from spring (28).

The injection procedure as disclosed in the foregoing permits a visual reading of the instantaneous position of the moving piston (27) by reason of the scale markings advantageously provided on the wall of the translucent outer tubing (25). Thus the invention permits forthright reading of the point of equilibrium achieved by both the acting pressure and the pressure of spring (28) by reason of its elasticity. Thus the present invention permits reading and therefore passing of judgment as to whether the pressure owing to the filler being discharged into the crevice has reached a required level, thereby serving to safeguard the quality of the patchwork in question.

Parties enlightened by the foregoing will also appreciate that the invention is totally devoid of any elastic component, rubber, to be specific, in the ensemble, as opposed to that utilized in conventional executions. Compaction results by thread-screwing effects and can better ensure safety by relieving the constituent parts from skip-explosion possibilities.

In summation, the present invention, by the provision of a piston which moves slidingly dependent upon the inner tubing that is furnished between the inner tubing and the outer tubing, makes possible the transmission of the piston by the backfeeding pressure occasioned within the injector owing to the incoming filler to a desired point of equilibrium whereat the injecting pressure is just offset by the responding pressure of the spring. This makes possible the reading of a correct pressure value of the filler acting into the crevice, by referring to the scale equipped on the outer tubing. Moreover, it relieves all the constituent parts thereof from susceptibility to skip-explosion incidents resulting from any backfed pressure emerging inside the invention injector since all the constituent parts are screw-threaded into position.

All the very true advantages recited in the foregoing are achievable according to the invention. Suffice it to say that the present invention is a truly worthwhile piece of invention in the form of a highly improved filler over conventional executions for application in the treatment of crevices found in the pillars, posts, supports of building anywhere.

What is claimed is:

1. Filler Injection Assembly which can apply a filler to a surface comprising an elongated, hollow outer tube that includes at one end an enclosed top with a bore therethrough and an opening at the other end, said outer tube having an inner diameter;

an inner tube having a bore therethrough and of a smaller diameter and shorter length than said outer tube, said inner tube being positioned in the bore of the enclosed top of the outer tube, the inner tube including a mounting therefor on top thereof for orienting the inner tube;

an adaptor having a bore therethrough;

a fastening cap which is screw-coupled to the top of said outer tube and which mounts said adaptor on the top of said outer tube, in doing so the mounting for the inner tube is compressed therebetween and said adaptor bore is in communication with said inner tube bore;

a piston having an outer diameter that is equal to the inner diameter of the outer tube and positioned inside said outer tube and having a bore therethrough; and a spring seated on top of said piston; said piston bore receiving said inner tube, and said piston being slidably movable up-and-down against said spring and in engagement with the inner tube which acts as a guide rail therefor;

whereby a filler introduced in said adaptor can travel through said inner tube and can be applied to the surface through the other end of said outer tube and any filler backing up from the surface can exert a pressure against said piston.

2. The filler injection assembly as claimed in claim 1 and further including means for sealing against a surface to which the filler is to be applied, said sealing means being mounted on the other end of said outer tube and having a bore therethrough in communication with said outer tube so that a filler introduced in said adaptor and travelling in said inner tube can be applied to a surface through the lower end of said outer tube.

3. The filler injection assembly as claimed in claim 2 and further including a check valve mounted in said assembly so that filler backing up from the surface can exert a pressure against said piston and not against additional filler being supplied to the surface.

4. The filler injection assembly as claimed in claim 3, wherein said check valve is mounted in said adaptor bore.

5. The filler injection assembly as claimed in claim 3 wherein said outer tube is transparent so that the position of said piston is visible.

6. The filler injection assembly as claimed in claim 5 wherein said outer tube has scale markings thereon so that the position of said piston can be determined with respect to said scale markings.

7. The filler injection assembly as claimed in claim 1 and further including a check valve mounted in said assembly so that filler backing up from the surface can exert a pressure against said piston and not against additional filler being supplied to the surface.

8. The filler injection assembly as claimed in claim 7, wherein said check valve is mounted in said adaptor bore.

9. The filler injection assembly as claimed in claim 1 wherein said outer tube is transparent so that the position of said piston is visible.

10. The filler injection assembly as claimed in claim 9 wherein said outer tube has scale markings thereon so that the position of said piston can be determined with respect to said scale markings.

11. Filler injection assembly which can apply a filler to a concrete surface comprising:

a transparent outer tube having scale markings thereon and an enclosed top with a central aperture therethrough;

an inner tube extending through the aperture with a peripheral outward extending flange at one end thereof in contact with the top of said outer tube;

an injector adaptor means screw-coupled to the upper end of said outer tube for compressing the flange of said inner tube against said outer tube top;

a check valve mounted in said adaptor means;

a piston slidable within the outer tube along the inner tube;

a spring biasing said piston downwardly away from the top of said outer tube;

and means for mounting said outer tube to a concrete surface.

* * * * *